US006474034B1

(12) United States Patent
Dronigi

(10) Patent No.: US 6,474,034 B1
(45) Date of Patent: Nov. 5, 2002

(54) SHUTTER FOR WINDOWS AND METHOD TO FIT SAID SHUTTER

(75) Inventor: Liliana Dronigi, Trieste (IT)

(73) Assignee: Emilio Antonini, Trieste (IT)

( * ) Notice: Subject to any disclaimer, the term of this patent is extended or adjusted under 35 U.S.C. 154(b) by 0 days.

(21) Appl. No.: 09/716,861

(22) Filed: Nov. 20, 2000

Related U.S. Application Data

(60) Provisional application No. 60/190,627, filed on Mar. 20, 2000.

(30) Foreign Application Priority Data

Nov. 19, 1999 (IT) ..... UD99A0207

(51) Int. Cl.[7] ..... E06B 5/00; E06B 7/08

(52) U.S. Cl. ..... 52/473; 52/745.16; 49/74.1; 49/505

(58) Field of Search ..... 52/202, 473, 745.15, 52/745.16; 49/74.1, 64, 67, 51, 505

(56) References Cited

U.S. PATENT DOCUMENTS

| | | | | | |
|---|---|---|---|---|---|
| 2,614,301 | A | | 10/1952 | Axtell | |
| 2,724,153 | A | * | 11/1955 | Dempsey | 49/505 |
| 2,834,071 | A | * | 5/1958 | Camerino | 52/202 X |
| 2,976,583 | A | * | 3/1961 | McCarthy | 52/745.15 X |
| 3,943,679 | A | * | 3/1976 | Dissinger | 52/473 |
| 3,968,738 | A | * | 7/1976 | Matzke | 52/473 X |
| 5,365,708 | A | * | 11/1994 | Winston | 49/505 X |
| 5,490,353 | A | | 2/1996 | McLaughlin | |
| 5,778,598 | A | * | 7/1998 | Ohanesian | 49/74.1 |

FOREIGN PATENT DOCUMENTS

| | | | | |
|---|---|---|---|---|
| AU | 63658 | * | 2/1914 | 49/74.1 |

* cited by examiner

*Primary Examiner*—Laura A. Callo
(74) *Attorney, Agent, or Firm*—Akin, Gump, Strauss, Hauer & Feld, L.L.P.

(57) ABSTRACT

Shutter for windows, and relative method to fit said shutter, comprising a rim (12) consisting of vertical uprights (14) and horizontal cross-pieces (13), an outer assembly box (11) suitable to be anchored at the sides (20) of a window opening, and a plurality of blades (15) attached transversely between the vertical uprights (14) and suitable to selectively obstruct the light filtering through the rim (12), wherein the assembly box (11) consists of a plurality of profiles (17) of equal section and substantially quadrangular comprising, on one side, a coupling tooth (16) defining substantially plane supporting surfaces **(19*a*, 19*b*) able to cooperate with mating surfaces of the sides (20) defining the window opening and/or with mating surfaces of the profiles (13, 14) defining the rim (12) of the shutter (10)**.

10 Claims, 5 Drawing Sheets

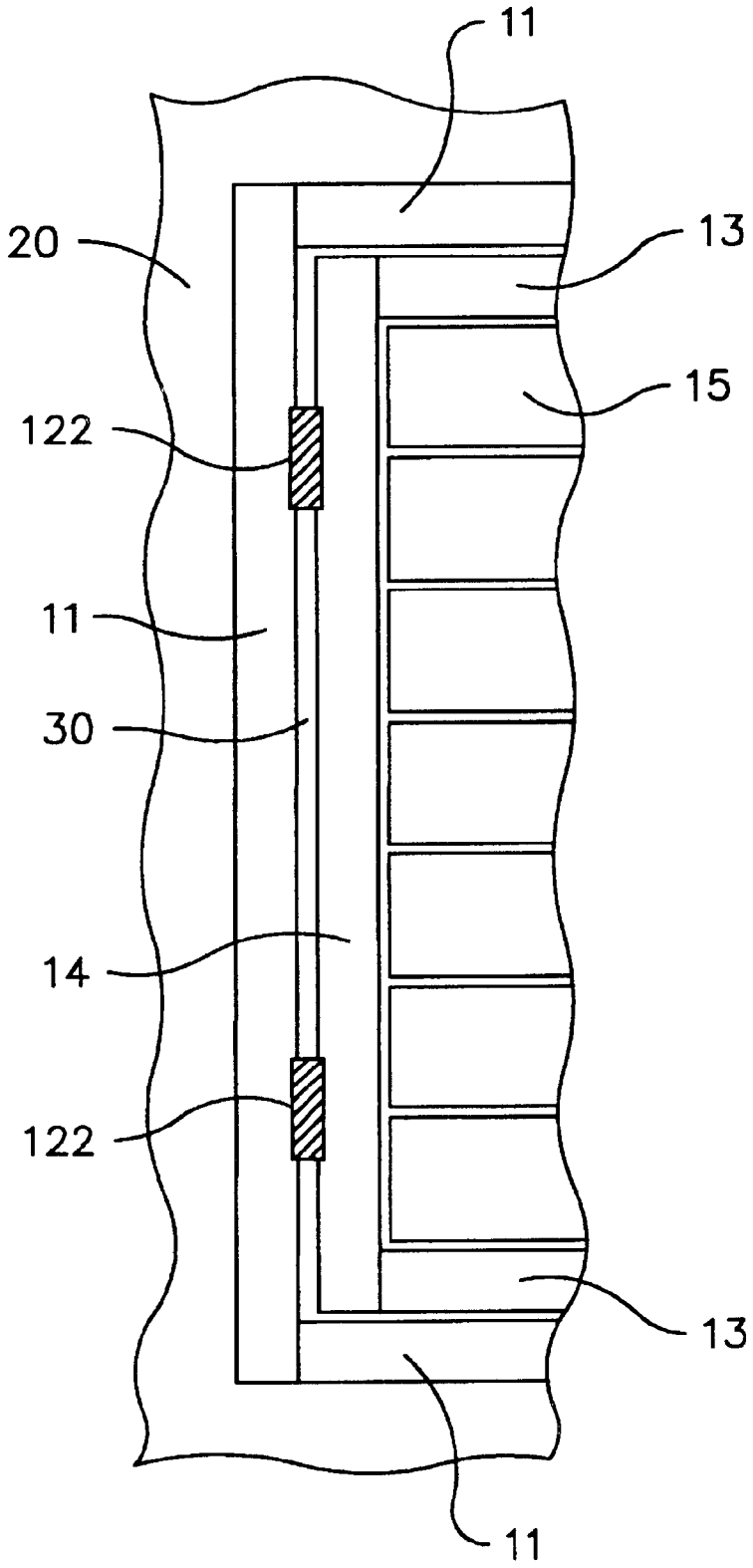
*Fig. 6b1*

SHUTTER FOR WINDOWS AND METHOD TO FIT SAID SHUTTER

CROSS-REFERENCE TO RELATED APPLICATION

This application claims the benefit of U.S. provisional patent application 60/190,627, filed Mar. 20, 2000.

FIELD OF THE INVENTION

This invention concerns a shutter for a window, of the type comprising a rim on which a plurality of blades, also called louvers or Venetian blinds, are attached transversely.

The blades are suitable to be moved between a position wherein they completely prevent the passage of the light, and a position wherein they allow the light to filter, more or less partially, through the window.

The shutter according to the invention is applied to the windows of any room whatsoever, in an inside or outside position, and substantially functions both as a window frame and also as a blind or shutter.

The invention also concerns the method to fit a shutter of the type described above in correspondence with the window opening.

In the following description we will refer mainly to shutters made of wood, fiberboard or wood derivates, but it is obvious that the present invention is applicable to shutters made of any appropriate material also including PVC, foam based material, metal, etc.

BACKGROUND OF THE INVENTION

In the field of window frames and furniture accessories, the state of the art includes the shutters which are applied to windows comprising a frame onto which a plurality of blades are applied transversely, adjacent and partly superimposed. The blades can be oriented by means of a simultaneous rotation on their axis to allow more or less light to pass from outside to inside the room.

The rim, normally rectangular or square and comprising uprights and cross-pieces, is usually anchored to a frame or box, attached to the masonry shoulders and traverses of the window opening.

These shutters are very much appreciated from a functional point of view, since they function simultaneously as a window frame and as a blind or shutters, and also from the aesthetic point of view, since it is possible to achieve very pleasant combinations of shapes and colors.

State-of-the-art solutions normally provide that the blades are moved by means of a rod, arranged transversely to the blades and attached to each one of them, normally located in a central position with respect to the shutter.

The shutters, which in most cases are made of wood or fiberboard or wood derivates, normally consist of a first type of profile with which the uprights of the rim are made, a second type of profile with which the cross-pieces of the rim are made, a third type of profile with which the outer box (which is anchored to the masonry shoulders and traverses) is made, and the blades with the relative drive rod.

A first problem connected with the production of these shutters is that it is necessary to store in the warehouse a large number of different pieces to be able to satisfy the requirements of different clients according to the preselected shapes and/or sizes of the shutter.

Other problems arise in the assembly step due to the limited versatility and flexibility of state-of-the-art profiles, which only allow univocal assembly positions; in general they are not able to overlap with any possible pre-existing rims assembled around the window opening, and they do not generally allow to diversify the assembly position of the shutter with respect to the masonry shoulders (flush, not flush, with a gap, covered, etc.).

A further disadvantage of state-of-the-art shutters of this type is that, in order to satisfy the clients' diverse requirements regarding shapes, colors and sizes, producers generally supply the fitters with semi-finished elements which need finishing operations before and during the fitting.

These finishing operations, which comprise at least a trimming to size, both lengthwise and transversely, one or more smoothing steps and one or more painting or varnishing steps, affect to a considerable degree both the fitting times and the final cost of the shutter and also, in some cases, the quality of the final product.

Let us consider, for example, the difficulties of painting the blades when they are assembled on the shutter; this operation is necessary after assembly to prevent the blades from being spoilt or scratched during the operation to attach them to the rim, if they are already painted. Moreover, pre-painting is not possible in all cases: frequently, the profiles are subjected before fitting to a longitudinal trimming to adapt the section to the size and shape of the window where the shutter is to be applied.

Another disadvantage in the state of the art is that, to be able to adapt the height of the blades to the size of the window, either the value of the overlap between the blades has to be varied, or the part of the blades hidden behind the respective cross-pieces has to be exploited, since it is not provided to modify or calculate, according to the application, the pitch with which the blades are attached to the rim.

All these features have until now entailed high costs and a very limited versatility of this type of shutter.

The present Applicant has devised and embodied this invention to overcome these shortcomings, making it possible to produce a shutter which is extremely versatile, standardized in its essential components but completely able to be personalized according to individual needs, at a reduced cost and with simplified methods, also optimizing the management of the stock and therefore the overall production costs.

SUMMARY OF THE INVENTION

The invention is set forth and characterized in the respective main claims, while the dependent claims describe other characteristics of the main embodiment.

The main purpose of the invention is to eliminate the shortcomings of the state of the art in the production of shutters of the type described above, providing an extremely versatile product, adaptable to every requirement of a structural type, deriving from the conformation and type of the specific application, and of an aesthetic type, according to the taste and needs of the clients.

Another purpose is to provide a product which is extremely easy to assemble and install, so that the fitter does not have to carry out long and complex operations which considerably affect the final cost and the final quality of the product.

These and other purposes of the invention, as shown hereafter, are obtained thanks to a shutter which is characterized in that it has an outside assembly frame or box suitable to be anchored to the sides of a window opening, wherein the box consists of a plurality of profiles of equal section, substantially quadrangular, comprising on one side a coupling tooth with at least a supporting surface able to cooperate with a mating surface of a side defining the window opening and/or with a mating profile defining the rim of the shutter.

According to another characteristic of the invention, the rim of the shutter consists of profiles defining respectively the uprights and the cross-pieces, wherein at least the profiles defining the uprights have a substantially quadrangular section comprising, on one side, a coupling tooth with at least a first plane supporting surface able to cooperate with a mating profile defining the box of the shutter.

According to another characteristic of the invention, the profiles of the cross-pieces also have a section with a coupling tooth defining an identical plane supporting surface.

According to a distinctive characteristic of the invention, the profiles with which the outer box, the uprights and the cross-pieces are made all have the same section.

This characteristic is extremely advantageous both during the production step and also during the fitting step, since it allows to minimize the stocks in the warehouse and to supply the fitter with finished elements, which only need to be cut transversely to size, in order to be adapted to the size of the window.

Therefore, with this invention, the blades can be supplied already painted to the fitter who thus does not have to make longitudinal cuts or complicated painting or trimming operations before assembling and fitting.

The fact that finished elements are supplied, straight from the production plant, entails a considerable advantage both in terms of cost and in assembly times.

The fact that there are reciprocal coupling teeth, mating and cooperating, allows to obtain varied assembly solutions.

For example, it is possible to achieve overlaps between the rim of the shutter and the elements of the box such as to maximize the light entering from the window opening, and/or to eliminate anti-aesthetic interstices through which the light passes in the line where the shutter and box are coupled, or between the separating uprights of two adjacent shutters.

BRIEF DESCRIPTION OF THE SEVERAL VIEWS OF THE DRAWINGS

These and other characteristics of the invention will become clear from the following description of some referential embodiments of the invention, given as a nonrestrictive example, with reference to the attached drawings wherein:

FIG. 6*b*1 shows a front view of a portion of the embodiment illustrated in FIG. 6*b*;

DETAILED DESCRIPTION OF THE INVENTION

Figure 1:
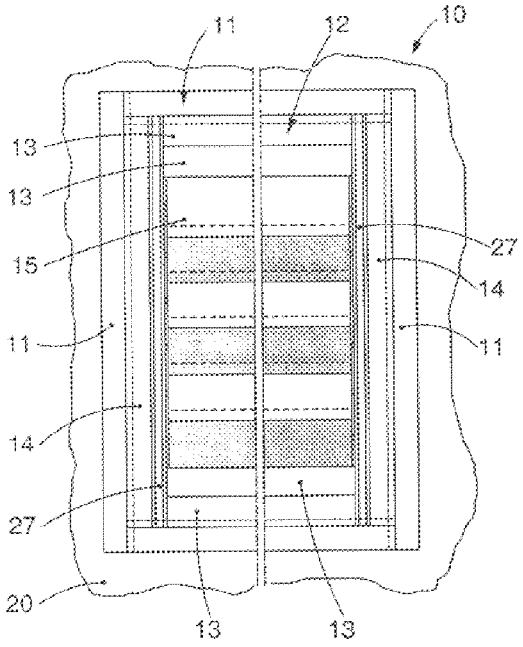
FIG. 1 shows a schematic front view of the whole shutter for windows according to the invention.

With reference to the attached drawings, number 10 denotes generally a shutter according to the invention, consisting of an outer box or frame 11 to be assembled on the window opening, a rim 12 consisting of uprights 14 and cross-pieces 13, and a plurality of blades 15 arranged horizontally which can be oriented from a position in which they completely obstruct the passage of light through the window to a position in which they let the light filter through to a greater or lesser extent.

In the shutter 10 the profiles 17 (FIG. 2) which constitute the box 11, and the uprights 14 and the cross-pieces 13 of the rim 12, all have the same shaped section, substantially rectangular, defined by two long sides, respectively 18*a* and 18*b*, and two short sides, respectively 18*c* and 18*d*.

On one of said short sides, in this case on the side 18*c*, there is a coupling tooth 16 able to define substantially plane supporting surfaces 19*a* and 19*b*, which can be made to cooperate with mating supporting surfaces so as to achieve particular assembly solutions according to the specific application.

To be more exact, the unified form of the section of said profiles 17 allows to obtain varied shapes which can be attached to the masonry shoulders 20 defining the window opening wherein the shutter 10 is applied.

Figure 3:
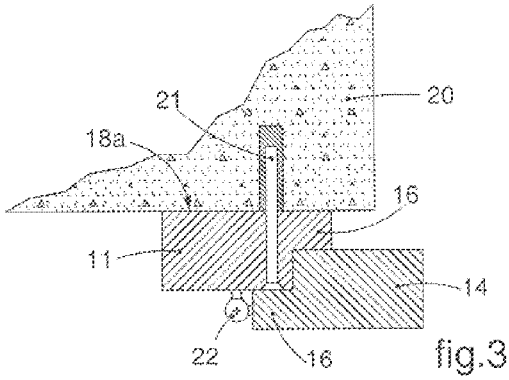
FIG. 3 is a part view of a first example of how the shutter shown in FIG. 1 is attached on the outside of a window opening.
Figure 4A:
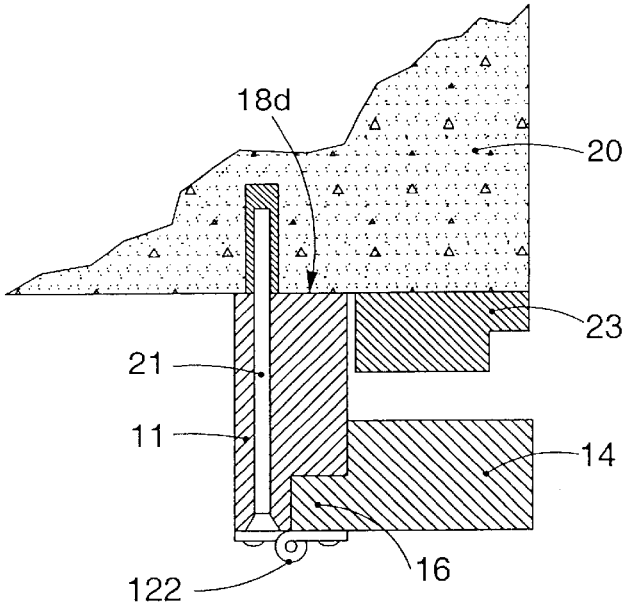
FIGS. 4*a* and 4*b* show variants of FIG. 3.
Figure 4B:
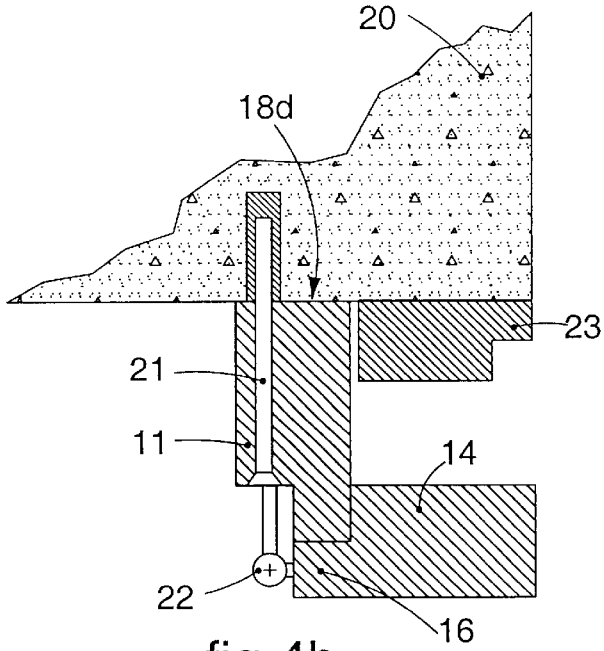

The solutions shown in FIGS. 3, 4*a* and 4*b* show attachment examples wherein the shutter 10, partly shown with one of its uprights 14, is assembled outside a window opening defined by the masonry element 20.

In the example shown in FIG. 3, the profile of the box 11, in this case an upright, or jamb, is positioned with one of its long sides 18*a* and the outer side of the tooth 16 against the wall 20.

The profile is anchored to the wall 20 by means of an anchoring bolt 21. The upright 14 of the rim 12 is coupled in a specular fashion with the relative box element 11 and made to overlap therewith by means of cooperation between the relative teeth 16.

This solution allows an extremely simplified coupling since it is obtained by making the two teeth 16 reciprocally abut; it also allows to use hinges 22 with a threaded pin to move the shutter 10.

The variant shown in FIG. 4*a* is substantially identical, with the difference that the box element 11 is resting with one of its short sides 18*d* on the wall 20; this solution allows to distance the upright 14 by a certain height from the wall 20, and thus to overlap possible outside rims 23 arranged around the perimeter of the window opening.

The solution shown in FIG. 4*b* provides that the box element 11 is assembled rotated by 180° with respect to the embodiment shown in FIG. 4*a*, that is, with its tooth 16 facing towards the upright 14; this solution is adopted when there are pre-existing outside rims 23 of a considerable height.

The embodiments shown in FIGS. 5, 6*a*–6*d* refer to when the shutter 10 is assembled on the inside of the window opening defined by the masonry element 20. In all the examples shown, between the box element 11 and the wall 20 a spacer element 24 is inserted, equipped with a through hole into which the anchorage bolt 21 is inserted.

Figure 5:
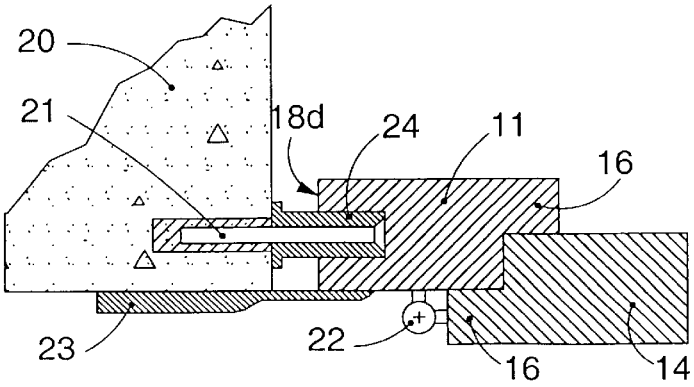
FIG. 5 shows a first example of how the shutter shown in FIG. 1 is attached on the inside of a window opening.

In the embodiment shown in FIG. 5, the box element 11 is assembled with its short side 18*d* facing towards the wall 20; the shutter is assembled overlapping, coupling the respective teeth 16 in a substantially identical manner to what is shown in FIG. 3, so as to define an assembly position of the shutter 10 which is outside with respect to the edge of the wall 20.

In this case too, this type of coupling allows to use movement hinges 22 with a threaded pin. The function of the outer rim 23 is to cover the interstice which is created between the wall 20 and the box 11.

Figure 6A:
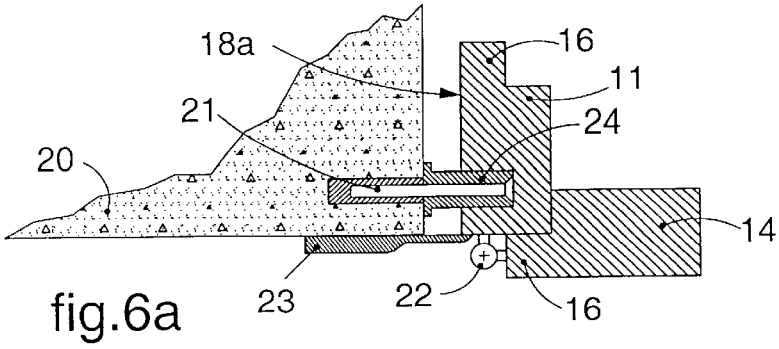
FIGS. 6*a*, 6*b*, 6*c* and 6*d* show variants of FIG. 5.

In the variant shown in FIG. 6*a*, the vertical box element 11 is coupled with its long side 18*a* facing towards the wall 20, and the upright 14 is arranged in an overlapping position with respect to the element 11. This solution reduces to a minimum the transverse bulk occupied by the box 11 and the upright 14, and therefore maximizes the overall inner gap available for the window.

Figure 6B:
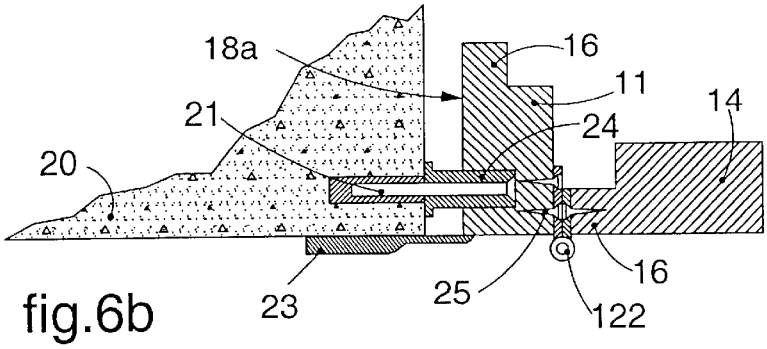

The solution shown in FIG. 6*b* is similar to that in FIG. 6*a*, with the difference that the upright 14 is not assembled overlapping, but flush with respect to the box element 11. This solution requires the use of hinges 122 of a different type, which are attached with screws 25 on the cooperating inner faces of the box 11 and upright 14. Moreover, the solution causes a gap to be formed between the upright 14 and box 11. The gap (or interstice) 30 shown in FIG. 6*b*1, permits light to pass between the box 11 and the upright 14.

Figure 6C:
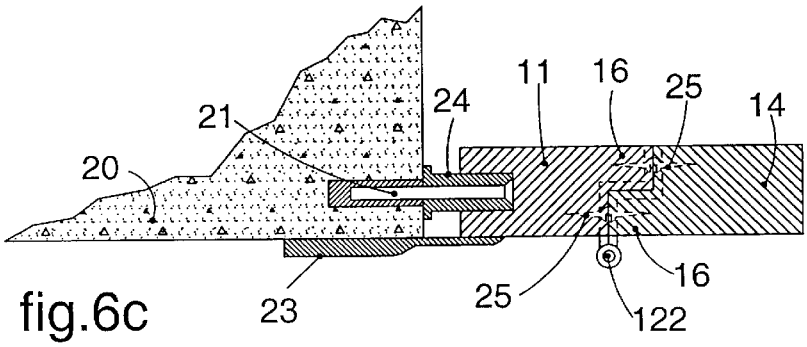

In the further variant shown in FIG. 6*c*, the box element 11 is coupled by its short side 18*d* with the wall 20, and its tooth 16 couples on the inside with the tooth 16 of the upright 14.

This solution allows the shutter 10 to be assembled flush with the wall 20, with the gap being completely covered.

Figure 6D:
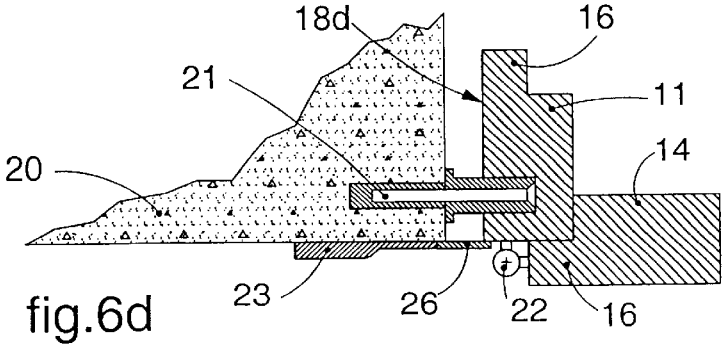

The further variant shown in FIG. 6*d* is similar to the solution shown in FIG. 6*a*, with the difference that a wirecover 26 is used in continuance of a pre-existing rim 23 so as to cover the interstice between the wall 20 and the box 11.

Figure 2:
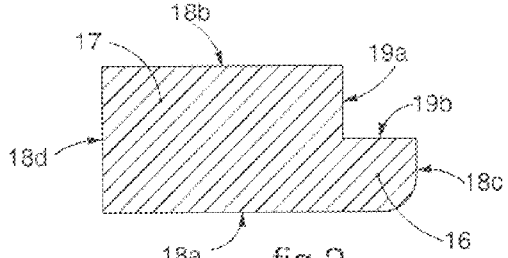
FIG. 2 is a section view of a profile used to make the box and the rim of the shutter shown in FIG. 1.

With regard to the cross-pieces 13, by using the profile 17 with the particular section as shown in FIG. 2, it is possible to achieve solutions wherein the end cross-pieces 13 overlap, in correspondence with the respective teeth 16, the respective box elements 11; moreover, the teeth 16 of the cross-pieces 13 cooperate with the highest and lowest blades 15, in their closed position, so as to. define respective shutter elements defining a condition of complete obscurity. FIG. 7*a* shows this solution, wherein some of the blades 15 also appear; for simplicity of illustration, the box elements 11 are not shown.

In this solution, the cross-piece 13 is obtained by coupling two profiles 17 joined together in a specular fashion in correspondence with the relative short sides 18*d* opposite the position of the tooth 16.

Figure 7B:
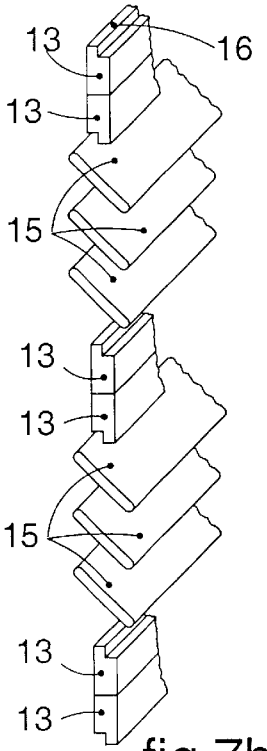
FIGS. 7*a* and 7*b* are prospective views of two further applications of the invention.
Figure 7A:
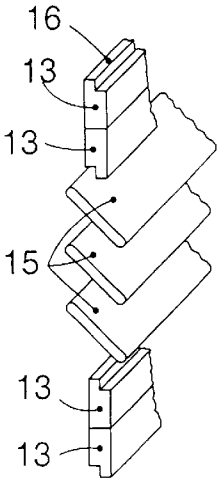

The variant shown in FIG. 7*b* provides that cross-pieces 13 can be inserted in an intermediate position too, so as to achieve separation elements with a horizontal development on the height of the shutter 10.

By using profiles 17 with a coupling tooth 16 it is possible to completely cover the gap not only in correspondence with the coupling of the uprights 14 and cross-pieces 13 with the relative box elements 11, but also in any possible couplings between intermediate dividing elements, also vertical ones.

Figure 8:
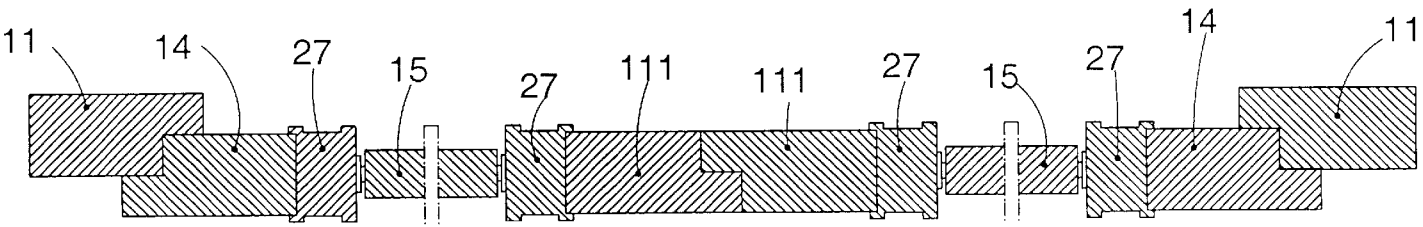
FIG. 8 shows a cross section of a further application of the invention.

FIG. 8 shows how it is possible to achieve a solution with modular shutters 10 arranged adjacent, wherein there is an overlap both between the lateral uprights 14 with the respective uprights of the box 11, and also between further intermediate uprights 111 arranged specular in pairs thanks to the cooperation between the respective teeth 16.

In this embodiment, profiles 27 are provided between uprights 14 and respective blades 15, which function as a union in correspondence with the coupling zones between uprights 14 and cross-pieces 13 and between uprights 14 and blades 15.

Figure 9:
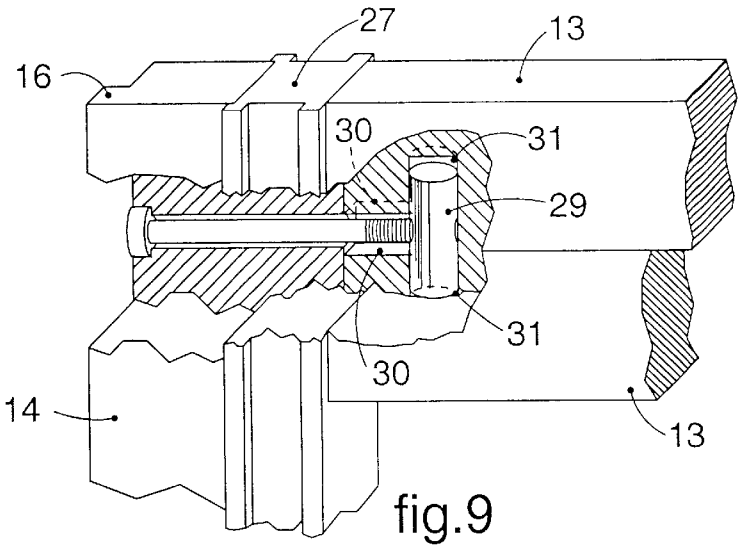
FIG. 9 shows a part section of another application of the invention.

By using the profile 17 as a cross-piece 13, it is also possible to insert hardware elements, such as common pins or a double cylinder 29 as shown in FIG. 9.

In this specific case, where two coupled cross-pieces 13 are used, the cylinder 29 is inserted by making a milling 30 in correspondence with one head of every cross-piece 13; the milling 30 communicates orthogonally with a dead hole 31 made in each of the cross-pieces 13.

From the fore-going description, it can be seen how the particular section shape of the profile 17 used for the box 11, uprights 14 and cross-pieces 13 of the shutter 10 confers extreme versatility and flexibility in assembly, and allows the shutter 10 to be adapted to every type of application made necessary by the pre-existing structure.

The fact that all the profiles are identical considerably rationalizes the production process of the shutters, for example with regard to managing stock, and the finishing and assembly procedures, since it allows to supply the fitter with finished, pre-painted elements which only need transverse cutting to size.

It is possible to make many modifications and constructional and conceptual variants to this invention, but they shall all come within the field defined by the attached claims.

I claim:

1. A shutter for windows comprising:

a rim having at least vertical uprights and horizontal cross-pieces;

an assembly box suitable to he anchored at the sides of a window opening; and a plurality of blades attached transversely between said uprights and suitable to selectively obstruct the light filtering through an aperture defined by said rim; wherein wherein said assembly box includes a plurality of profiles of equal section, said profiles of said assembly box being substantially quadrangular and being provided on one side with a coupling tooth of substantially plane supporting surfaces able to cooperate with mating surfaces of the sides defining the window opening and/or with mating surfaces of one or more profiles defining said uprights and cross-pieces of said rim; and wherein said uprights are made with one or more profiles equal in section to said profiles of said assembly box.

2. A shutter for windows comprising:

a rim having at least vertical uprights and horizontal cross-pieces;

an assembly box suitable to be anchored at the sides of a window opening; and a plurality of blades attached transversely between said uprights and suitable to selectively obstruct the light filtering through an aperture defined by said rim;

wherein said assembly box includes a plurality of profiles of equal section, said profiles of said assembly box being substantially quadrangular and being provided on one side with a coupling tooth defining substantially plane supporting surfaces able to cooperate with mating surfaces of the sides of the window opening and/or with mating surfaces of one or more profiles defining said uprights and cross-pieces of said rim; and wherein said cross-pieces are made with one or more profiles equal in section to said profiles of said assembly box.

3. A shutter for windows comprising:

a rim having at least vertical uprights and horizontal cross-pieces;

an assembly box suitable to be anchored at the sides of a window opening; and a plurality of blades attached transversely between said uprights and suitable to selectively obstruct the light filtering through an aperture defined by said rim;

wherein said assembly box includes a plurality of profiles of equal section, said profiles of said assembly box being substantially quadrangular and provided on one side with a coupling tooth defining substantially plane supporting surfaces able to cooperate with mating surfaces of the sides of the window opening and/or with mating surfaces of one or more profiles defining said uprights and cross-pieces of said rim; and wherein said shutter further comprises an auxiliary profile between said uprights and said cross-pieces, and between said uprights and said plurality of blades.

4. A method to fit a shutter using finished and pre-painted profiles which do not require any further working except to be cut to size in a transverse direction, the shutter comprising a rim having at least vertical uprights and horizontal cross-pieces; an assembly box suitable to be anchored at the sides of a window opening; and a plurality of blades attached transversely between said uprights and suitable to selectively obstruct the light filtering through an aperture defined by said rim; wherein said assembly box, said uprights and said cross-pieces include a plurality of profiles of equal section, said profiles of said assembly box, said uprights and said cross-pieces having a substantially rectangular section defined by two long sides and by two short sides, and being substantially quadrangular and provided on one short side with a coupling tooth defining substantially plane supporting surfaces able to be coupled cooperatively and/or to cooperate with mating surfaces of the sides of the window opening, the method comprising:

coupling said profiles of said assembly box to the sides of the window opening, in a fixed fashion and by means of assembly elements, and coupling in a removable fashion said profiles of said uprights and/or said cross-pieces with said profiles of said assembly box by means of elements functioning as hinges, wherein said coupling between said assembly box and said uprights and/or said cross-pieces being made by coupling one or more of said plane supporting surfaces of said coupling teeth of said profiles of said assembly box, said uprights or said cross-pieces.

5. The method as in claim 4, wherein said profile of said assembly box is coupled by one of said long sides with a side of said window opening, and wherein said profiles of said uprights and/or said cross-pieces are coupled with said profile of said assembly box by overlapping one or more of said plane supporting surfaces of said coupling teeth.

6. The method as in claim 4, wherein said shutter is assembled on an outside of said window opening, wherein said profile of said assembly box is coupled by one of said short sides with a side of the window opening, such that said profile of said uprights can overlap an outer pre-existing rim arranged around the perimeter of the window opening.

7. The method as in claim 4, wherein said shutter is assembled on an inside of the window opening, and wherein said profile of said upright is assembled flush with said profile of said assembly box and with a wall surface around the window opening, and wherein hinge means attach said upright to said assembly box and create an interstice which allows light to pass between said assembly box and said upright.

8. The method as in claim 4, wherein said shutter is attached on an inside of said window opening, and wherein said profile of said upright is assembled flush with said profile of said assembly box and with a wall surface around the window opening, and wherein said coupling teeth of said profiles of said assembly box, said uprights overlap.

9. A shutter for windows comprising:

a rim having at least vertical uprights and horizontal cross-pieces;

an assembly box suitable to be anchored at the sides of a window opening; and a plurality of blades attached transversely between said uprights and suitable to selectively obstruct the light filtering through an aperture defined by said rim, said uprights and said cross-pieces including a plurality of profiles of equal section, said profiles of said uprights and said cross-pieces being substantially quadrangular and being provided on one side with a coupling tooth defining substantially plane supporting surfaces able to cooperate with a mating surface of a mating profile of said assembly box.

10. A shutter as in claim 9 wherein each of said cross-pieces comprise a plurality of profiles of equal section, said coupling tooth of said cross-pieces being able to cooperate with a mating surface of a profile of said assembly box and/or said blades to prevent the passage of light through the window opening.

* * * * *